United States Patent [19]

Lopez C.

[11] 4,002,022

[45] Jan. 11, 1977

[54] ELECTRO-MECHANICAL SIGN STRUCTURE WITH ALTERNATING FACES FORMED BY SEVERAL ADJACENT DIHEDRAL ANGLES

[76] Inventor: Guillermo Lopez C., 102 W. Crockett St., P.O. Box 2663, San Antonio, Tex., 78299

[22] Filed: Oct. 1, 1974

[21] Appl. No.: 511,055

[52] U.S. Cl. ..... 58/126 R; 40/77.7; 58/125 R

[51] Int. Cl.[2] ..... G04B 19/00; G09F 11/02; G04B 19/02

[58] Field of Search ..... 40/77.7; 58/1, 23 R, 58/125 R, 125 A, 125 C, 126 R, 126 E, 127 R

[56] References Cited

UNITED STATES PATENTS

| | | | |
|---|---|---|---|
| 2,277,323 | 3/1942 | Hjernstad et al. | 40/77.7 |
| 2,677,205 | 5/1954 | Wyatt | 40/77.7 |

*Primary Examiner*—E. S. Jackmon

[57] ABSTRACT

An electro-mechanical sign which alternatively exhibits two different kinds of information, for example clock or sign display information, on two respective faces of several adjacent dihedral angles.

8 Claims, 8 Drawing Figures

ELECTRO-MECHANICAL SIGN STRUCTURE WITH ALTERNATING FACES FORMED BY SEVERAL ADJACENT DIHEDRAL ANGLES

This invention is referred to an electro-mechanical sign which alternately exhibits or displays two different illustrations or messages painted or adhered on both faces of several adjacent dihedral angles. The construction of this apparatus permits also to illuminate the sign whether from outside if the sign is displayed on opaque materials or from the inside if it is made on translucent or transparent materials. Besides due to the construction features of this invention, it can be used for several attractive effects, such as the one already mentioned of two alternating displays, or to display an actual clock alternatively with a sign, being also possible to alternatively exhibit two different signs while a clock also displayed is in function.

Other important features of my invention are the advantages over some other sign apparatus with the same final effect, this is the alternating display of two signs, as it permits the translucent effect which is not possible in the already existing slide type construction or in the revolving panel type also existing. Compared with the also existing design of revolving triangles, my invention comprises the advantage, because of the way as its construction is conceived, of a very secure and free of trouble performance.

Another important embodiment of my invention is a special electrical circuit which any time that the motion system should be stopped allows the correspondent faces of the dihedral angles to be correctly aligned and positioned in order to show the continuous surface of the display. In order to fully describe my invention I have illustrated the same on the two accompanying sheets of drawings wherein are shown embodiments of the invention, in the understanding that changes, variations and modifications may be resorted to which fall within the scope of the invention as claimed. In said drawings:

Figure 4:
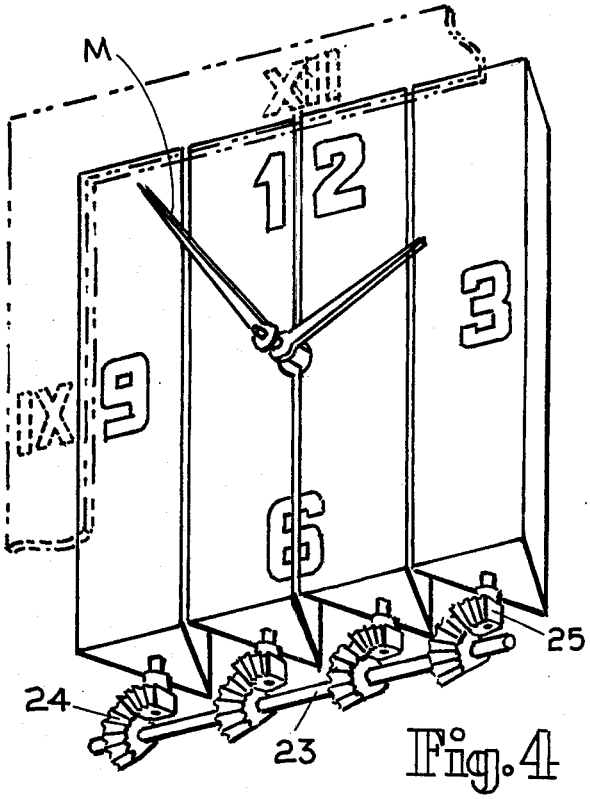

FIG. 4 shows the embodiment of the sign when used for displaying alternately a clock face and a sign. The clock face can be also arranged on an outer frame, thus allowing both changing sequences to be used for two different signs. This figure also indicates a different system of timed transmission for the motion of the dihedral angles.

Figure 5:
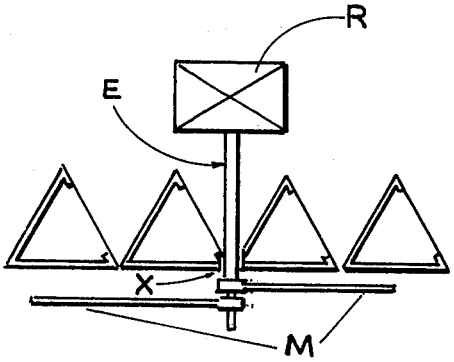

FIG. 5 a plane view of the arrangement described in FIG. 4.

Figure 6:
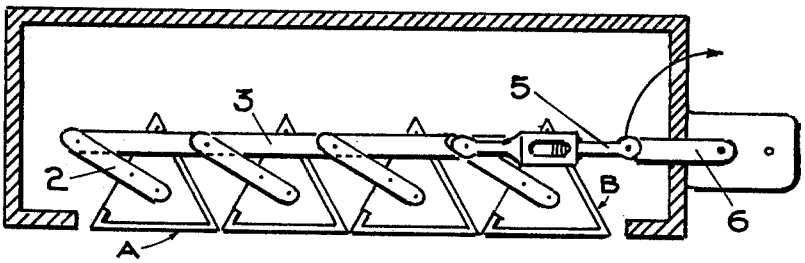

FIG. 6 is a view of the adjacent dihedral angles presenting one of their faces to the front.

Figure 7:
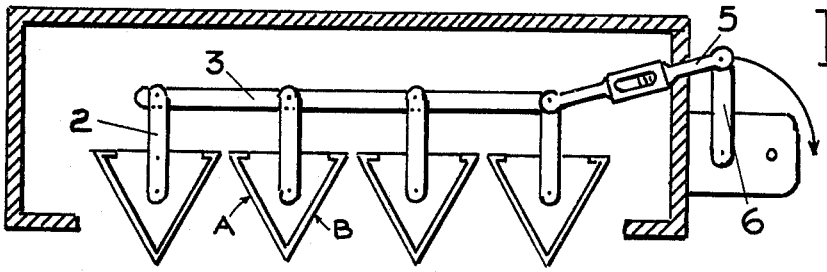

FIG. 7 shows the stage at the middle of the sequence.

Figure 1:
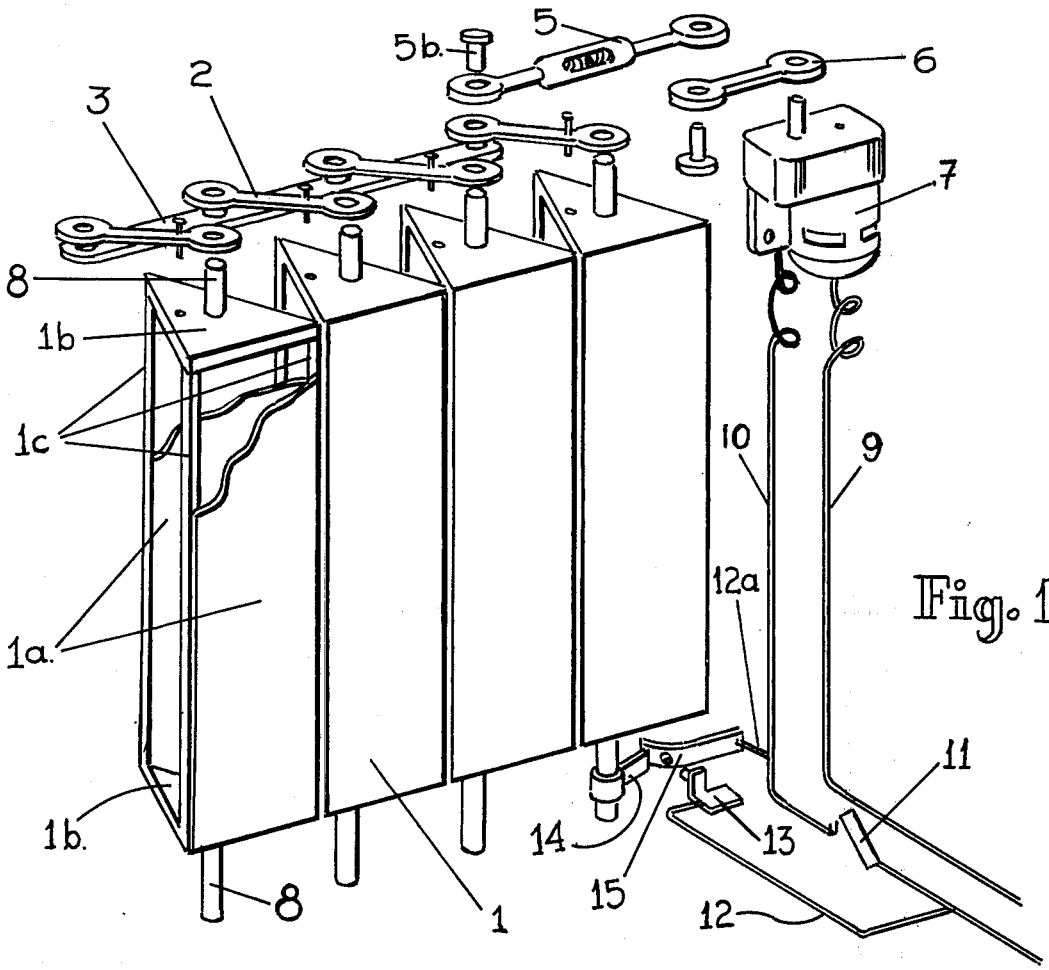
FIG. 1 is a perspective view of the basic structure of this sign and its component parts.
Figure 8:
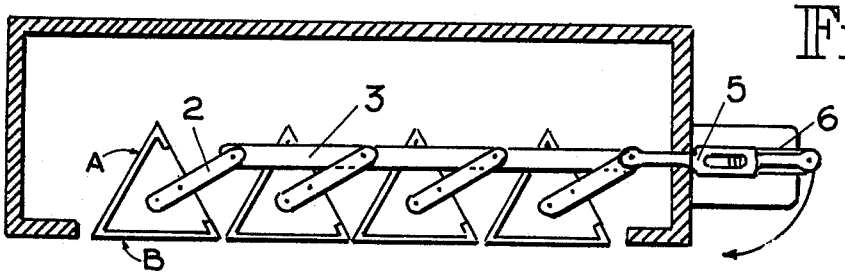

FIG. 8 is a plane view with the other faces of the dihedral angles exposed at the front of the sign. The sign structure as illustrated in FIG. 1 comprises several dihedral angles 1, one another in a successive adjacent position, the faces 1-A- of said dihedral angles being supported on a triangular prismatical structure formed by two opposite triangular bases 1-B- and three correspondent upright members 1-C-. In the case of small signs such upright members may be omitted. Conveniently attached to each of the opposite bases which support the referred dihedral angles there is a pair of short axle shafts 8, one for each angle structure. These axle shafts are mounted on bearing balls held in a bearing structure arranged at the top and bottom members of an outer frame housing which is not shown in the drawing. The before said dihedral angles rotate back and forth on their shafts 8, the angular displacement required to exhibit each of their faces alternately and synchronously at the front of the sign. Such angular rotation is obtained by means of the lever links 2, which are attached at one of their ends to the shaft 8, of each dihedral angle structure by means of set screws and also fixed to the triangular bases 1-B at the middle of the face opposite to the vertex of the dihedral angle. The other ends of said lever links 2 are each of them pivotally connected to the traveling bar 3 which actuates said lever links in order to rotate the dihedral angle structures. I consider important to point out that the assembly of travelling bar and lever links is convenient to have it installed at both upper and lower ends of the dihedral angle structures in order to prevent the inertia twisting effect to be expected in large size models. Said travelling bar 3 is actuated by the pitman bar 5 there to connected by pin 5-B. The pitman bar 5 consists of an extension bar, therefore making possible any adjustment on its length when said mechanism is being set up. The pitman bar 5 actuates the travelling bar 3 because of its reciprocating motion which is transmitted when the connecting link 6 is continuously rotated by means of electric motor 7. The way as the electric circuit to start and stop the motor 7 is wired allows that the angular rotation of the dihedral angle structures 1 stops only when the dihedral angles have completed their entire stroke thus being possible to achieve that the dihedral angles will never show their vertices at the front of the sign, when the power is off. The electric motor 7 receives power through lines 9 and 10, this line 10 is interrupted when the starting switch 11 is disconnected, however the flow of energy is not broken, as it continues through the shunt line 12 until one of the dihedral angles, when completing its stroke and by means of latch 14 operates the auxiliary switch formed by support 13 and spring bar 15 and cuts off the power supply to line 12-A- and consequently to the motor 7.

Figure 2:
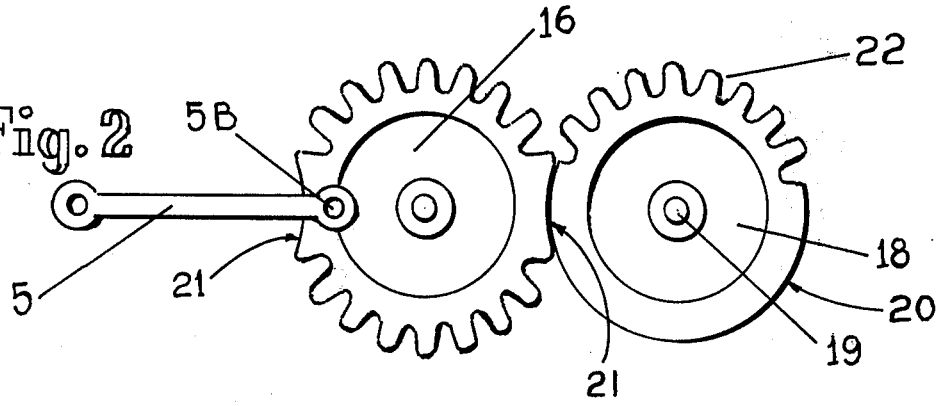
FIG. 2 is the front view of a set of gears to obtain intermittent motion allowing the signs to be exhibited during several seconds after every change.

In order to provide means for the dihedral angles to remain inoperative for a certain period after each angular travel so that the sign there on displayed can be appreciated for a longer time I have designed the gear set shown at FIG. 2 which is to be connected in the embodiment described in FIG. 1 instead of the connecting link 6, this is to transmit the motion of the motor 7 to the pitman bar 5. It is very simple to understand that the motion received from the motor 7 at the gear 18 can be only transmitted to the gear 16 when the toothed section 22 of gear 18 engages with any of the two toothed sections of gear 16. Gear 18 has the round section 20 with a smooth contact surface to slide against the reversed round surfaces of sections 21 of gear 16 during its idle period. Gear 16 is connected to the pitman bar 5 and end 5-B.

Figure 3:
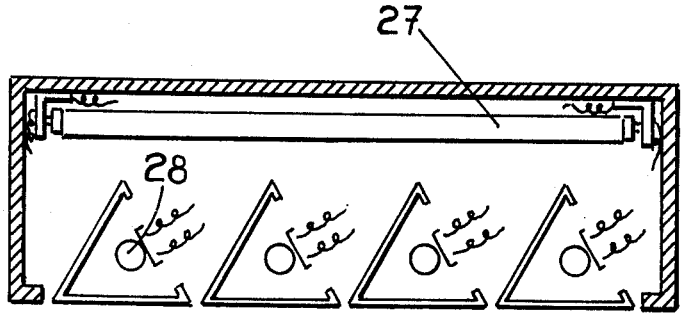
FIG. 3 is a plane view of the sign showing two different ways to illuminate the signs from the inside.

Two ways to illuminate the sign displayed on the rotating adjacent dihedral angles when translucent or transparent material is used are exposed at FIG. 3. One of them consists of several fluorescent lamps 27 installed at the back of the housing, which obliquely illuminates the front faces of the dihedral angles without annoying shadows of the hidden faces, this being possible because of their oblique position in regard to the front faces. Another way to obtain illumination from the inside, consists of individual fluorescent lamps 28 installed inside each of the dihedral angles thus permitting a closer and more complete illumination; of course the power lines should have the convenient length to allow the angular rotation of the dihedral angles.

When it is desired to use this embodiment to build a sign in which a clock in actual motion is exhibited alternately with some other message the clock mechanism is located and conveniently supported at the back of the dihedral angles embodiment as shown in FIG. 5. An extension of the clock hands shaft -E- is carried through a circular hole -X- between two of the central dihedral angles and out to the front of the display where finally the clock hands -M- are conventionally mounted. Due to the partial angle rotation of the dihedral angles, the hand shaft -E- of the clock will never interfere with the dihedral angles motion. FIG. 4 shows the appearance of the above described installation showing the faces of the dihedral angle with the numerals of the clock face therein painted or adhered. In this same figure a frame on dotted line is illustrated to indicate an optional place for the numerals of the clock if two different signs are to be alternately exposed while the clock face is also exhibited on the frame.

A different way to transmit the simultaneous motion to the dihedral angles is also described in FIG. 4, consisting of a transmission shaft 23 conveniently supported having as many angle gears 24 as dihedral angles are to be driven, each of them engaging with the correspondent pinion attached to the short axle shaft of each dihedral angle. In such construction the dihedral angle structure nearest to the drive motor receives motion through the pitman bar 5 and transmits this movement to the transmission shaft which operates all the other dihedral angles simultaneously. For economical reasons if angle gears are to be used in a high volume production, these can be made by casting them as partial or sectioned gears and pinions.

The sequence of motion of the group of dihedral angles is described in FIGS. 6 - 7 - and 8-, FIG. 6 shows all the correspondent faces -A- of the successive adjacent angles oriented to the front of the sign and the travelling bar 3 at the extreme left position with all the lever links 2 in the operational position, the other faces -B- of the dihedral angle are hidden from the front of the sign. It is convenient to point out that the angle subtendend by the lever links with regard to the front faces of the sign is the most convenient in order that the travelling bar be able to pull such lever links starting from the extreme left or right positions of the connecting link, due to the existing moment of force therein involved the pitman bar 5 and the connecting link 6 are also at the extreme left position of the stroke - L -.

FIG. 7 shows the position of component parts of my invention at the middle point of the stroke which is readily understandable. Finally FIG. 8 shows the sign embodiment when faces -B- of the dihedral triangles are exhibited at the front of the sign while faces -A- are out of sight. At this stage the travelling bar 3, the lever links 4 as well as pitman bar 5 and connecting link 6 are at their extreme right position, once the connecting link 6 has completed a half of revolution.

Once I have described my invention, I am aware that many changes can be made in its details as here embodied for purposes of illustration without departing from the spirit there of and I do not therefore limit the invention to the particular embodiments thereof here shown, except as I may be limited by the hereto appended claims.

What I claim is:

1. An electromechanical sign structure comprising a frame, several adjacent dihedral angles contained inside said frame, means connected to said dihedral angles for rotating said angles back and forth in an angular motion to alternately exhibit each of the two faces of all the dihedral angles synchronously at the front of the frame, thus forming a continuous surface on which a sign or message has been placed, means in the frame supporting said rotating adjacent dihedral angles, said rotating means including a series of angle gears and pinion gears, a pinion gear being mounted on each of the dihedral angles, a rotary transmission shaft supporting the angle gears to transmit a rotational motion to said angle gears to thereby transmit a synchronized back and forth rotational movement to said dihedral angles to allow the sign formed by the adjacent faces to remain stationary for several seconds in the frame, means to stop the back and forth angular motion only when dihedral angles have completed their predetermined entire angular stroke, means to optionally illuminate the faces of said dihedral angles, said electromechanical sign structure further including a clock mechanism, means to support said clock mechanism, rearwardly of said dihedral angles, said mechanism having a clock hands shaft protruding through and between two dihedral angles disposed forwardly thereof to the front face of the frame, clock hands attached to the shaft forwardly of the front face means to exhibit the numerals of the clock face on the front of the sign.

2. The sign of claim 1 wherein the clock numerals are disposed on the dihedral angles.

3. The sign of claim 1 wherein the clock numerals are disposed on the frame.

4. The sign of claim 1 wherein the light means is disposed inwardly of the sign.

5. An electromechanical sign structure comprising a frame, several adjacent dihedral angles contained inside said frame, means connected to said dihedral angles for rotating said angles back and forth in an angular motion to alternately exhibit each of the two faces of all the dihedral angles synchronously at the front of the frame, thus forming a continuous surface on which a sign or message has been placed, means in the frame supporting said rotating adjacent dihedral angles, said rotating means including a link pivoted at one end to each of said dihedral angles and at its other end to an activating member, motor means connected to said activating member for reciprocating the same to thereby transmit a synchronized back and forth rotational movement to said dihedral angles to allow the sign formed by the adjacent faces remain stationary for several seconds in the frame, means to stop the back and forth angular motion only when dihedral angles have completed their predetermined entire angular stroke, means to optionally illuminate the faces of said dihedral angles, said electromechanical sign structure further including a clock mechanism, means to support said clock mechanism, rearwardly of said dihedral angles, said mechanism having a clock hands shaft protruding through and between two dihedral angles disposed forwardly thereof to the front face of the frame, clock hands attached to the shaft forwardly of the front face means to exhibit the numerals of the clock face on the front of the sign.

6. The sign of claim 5 wherein the clock numerals are disposed on the dihedral angles.

7. The sign of claim 5 wherein the clock numerals are disposed on the frame.

8. The sign of claim 5 wherein the light means is disposed inwardly of the sign.

* * * * *